US005495947A

United States Patent [19]

Zarske

[11] Patent Number: 5,495,947

[45] Date of Patent: Mar. 5, 1996

[54] BINGO BOX

[76] Inventor: Donald E. Zarske, 3965 Sunstream Pkwy., Virginia Beach, Va. 23456

[21] Appl. No.: 369,105

[22] Filed: Jan. 5, 1995

[51] Int. Cl.[6] ..... A63F 7/22; A45C 11/00

[52] U.S. Cl. ..... 206/579; 206/315.1; 273/148 A; 273/309

[58] Field of Search ..... 206/315.1, 579; 273/148 A, 269, 309

[56] References Cited

U.S. PATENT DOCUMENTS

| | | | |
|---|---|---|---|
| 4,337,861 | 7/1982 | Smart | 206/579 |
| 5,028,048 | 7/1991 | Watson et al. . | |
| 5,054,783 | 10/1991 | Hull et al. . | |
| 5,120,069 | 6/1992 | Shaw . | |

*Primary Examiner*—Jimmy G. Foster
*Attorney, Agent, or Firm*—Griffin, Butler, Whisenhunt & Kurtossy

[57] ABSTRACT

A bingo box (10) comprises substantially identical first and second relatively rigid containers (12, 14) each having a hinged angled panel (38) for providing a working angled surface (36) with clamps (48) at one end thereof. The first container includes a right hinge means at an intersection of its tapered right edge wall (20) and base sidewall (16) and the second container including a left hinge means at an intersection of its tapered left edge wall and base sidewall. The right and left complementary hinge elements are selectively engagable with one another for allowing the first and second containers to rotate relative to one another between a carrying configuration in which the base sidewalls are adjacent one another and a working configuration in which the base and work sidewalls (18) are approximately coplanar to one another. Storage spaces can be accessed via the hinged angled panels when the containers are in both the carrying configuration and the working configuration. Footpads (62*a–d*) protect the right and left hinge elements.

12 Claims, 4 Drawing Sheets

BINGO BOX

BACKGROUND OF THE INVENTION

This invention relates generally to the art of portable desks and more specifically to a portable desk useful for playing bingo and similar games.

People who play bingo often have a great deal of supplies to carry about, such as clobbers, glue, pencils, ashtrays, portable desks, and the like. Further, many bingo players play up to eighteen bingo cards per game and, in order to do this, require efficient work surfaces for maintaining the cards in ordered and convenient arrangements. Such people often need to access their supplies both when they are playing bingo and when they are transporting the supplies. Many serious bingo players employ special containers for transporting their bingo supplies and some employ portable desks on which they place their cards when they are playing bingo.

It is an object of this invention to provide a bingo box which, in a carrying configuration, can be used for transporting bingo supplies but which can also be converted into a desk, in a working configuration, in which it is used for efficiently holding a multitude of bingo cards for playing the cards.

It is also an object of this invention to provide such a bingo box which efficiently stores bingo supplies, as well as other items, both in the carrying configuration and in the working configuration.

Similarly, it is an object of this invention to provide such a bingo box having hinged cover panels which can be used for accessing storage spaces within the bingo box when the bingo box is both in the carrying configuration and in the working configuration.

There have been a number of portable bingo desks suggested in the prior art. For example, U.S. Pat. No. 5,120,069 to Shaw discloses a bingo work station comprising first and second housings hinged together at bottom edges thereof. However, the bingo work station of Shaw cannot be used as a storage container nor can it be used for transporting supplies and other items. Shaw's housings are open at the bottom for containing lights and foldable leg members which can be easily accessed from the bottoms of the housings.

U.S. Pat. No. 5,028,048 to Watson et al. describes a game carrying and playing apparatus which has a trapezoidal configuration to create a beveled desk surface. A member forming the beveled surface also serves as a cover so that things can be placed in a case. Although there is a handle on Watson et al.'s case, the case is non-symmetrical and it appears that it would be clumsy to transport. Similarly, it also appears that it would be inconvenient to access the case when the case is in a carrying mode. That is, if the beveled surface were opened when the case is in a carrying mode, things in the case would fall out of the case. Yet another difficulty with the device shown in the Watson et al. patent is that it would have to be unduly long and clumsy in order to hold eighteen bingo cards. Finally, an accessory tray of the Watson et al. patent is a separate part and appears to be clumsy to store and use.

It is an object of this invention to provide a bingo box which is easily foldable between a carrying configuration and a working configuration, can be easily used for storing and transporting bingo supplies, allows convenient access to such supplies both in the carrying configuration and in the working configuration, is symmetrical in the carrying configuration with an enlarged bottom and a tapered top having a handle, and forms an excellent working surface in the working configuration for efficiently holding at least eighteen bingo cards.

SUMMARY OF THE INVENTION

According to principles of this invention, a bingo box includes first and second relatively rigid containers each having wider and narrower end walls, tapered right and left edge walls, and base and work sidewalls for defining a storage space therein. The first container includes a left complementary hinge element at an intersection of a left end wall and a base sidewall thereof and the second container includes a right complementary hinge element at an intersection of a right end wall and a base sidewall. The right and left complementary hinge elements can be engaged with one another for allowing the first and second containers to rotate relative to one another so that the base sidewalls can be placed adjacent one another in a carrying configuration and coplanar to one another in a working configuration. In the working configuration the work sidewalls form a wide work surface. In one embodiment the first and second containers are substantially identical, with each respectively having left and right hinge elements at opposite left and right edges of its base sidewall. Offset footpads are on an outer surface of the base sidewall to prevent the hinge elements from contacting a support surface when the bingo box is in a working configuration. The work surface on the work sidewall is formed by a hinged angled panel and a rigid panel at an intersection with the wider end wall.

BRIEF DESCRIPTION OF THE DRAWING

The invention is described and explained in more detail below using the embodiments shown in the drawings. The described and drawn features, in other embodiments of the invention, can be used individually or in preferred combinations. The foregoing and other objects, features and advantages of the invention will be apparent from the following more particular description of a preferred embodiment of the invention, as illustrated in the accompanying drawings in which reference characters refer to the same parts throughout the different views. The drawings are not necessarily to scale, emphasis instead being placed upon illustrating principles of the invention in a clear manner.

DESCRIPTION OF THE PREFERRED EMBODIMENT

Figure 1:
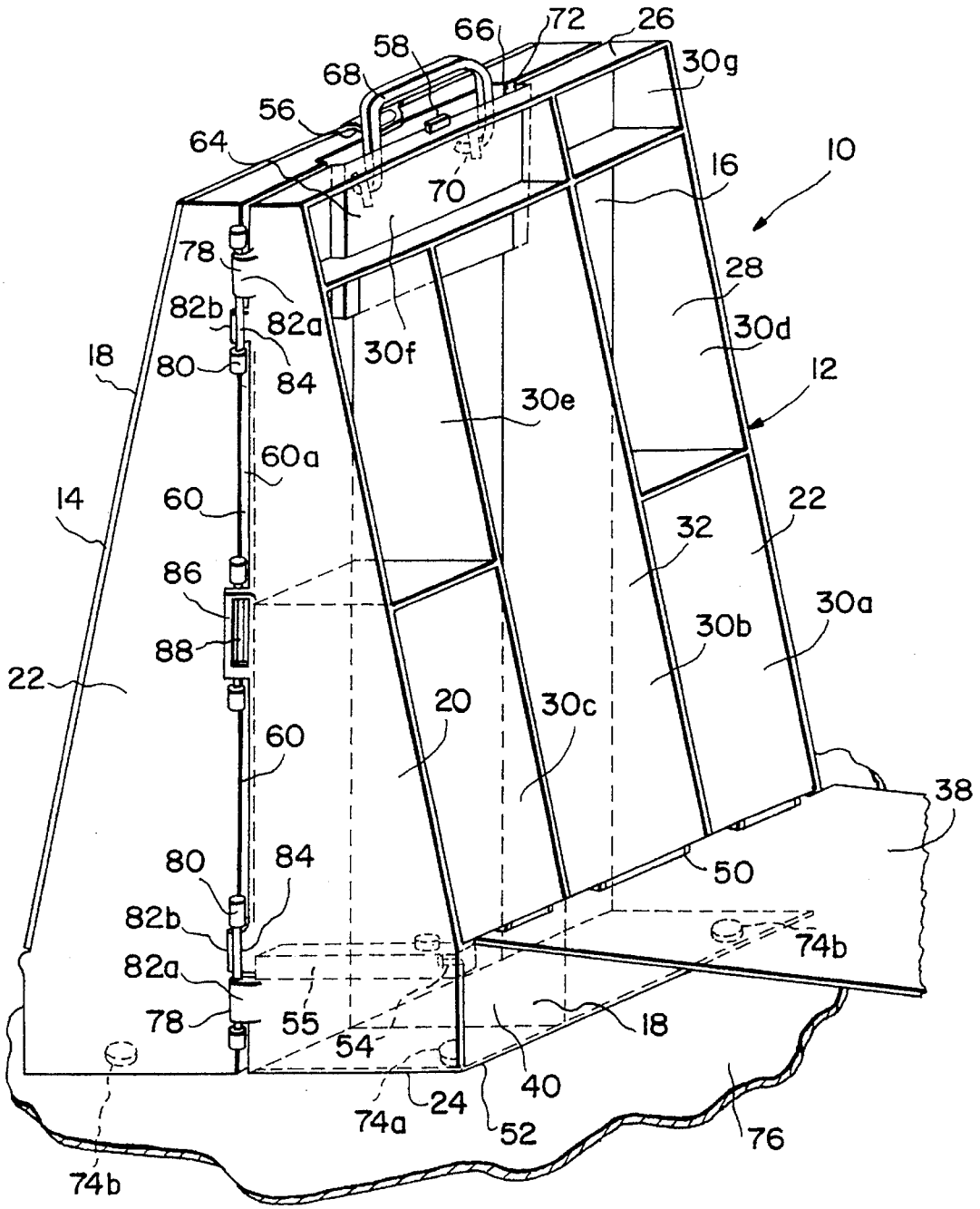
FIG. 1 is an isometric view of the bingo box of this invention folded into a carrying configuration, supported on a floor support surface, with a hinged angled panel of a left container thereof being open.

A bingo box 10 includes relatively rigid first and second containers 12 and 14. The first and second containers 12 and 14 are identical in structure., each having base and work sidewalls 16 and 18 opposite each other, tapered right and left edge walls 20 and 22 opposite each other, and wider and narrower end walls 24 and 26 opposite each other. These walls are interconnected substantially orthogonal to one another to define a storage space 28. The storage space 28 is divided into storage compartments 30*a–g* by interior dividers 32.

Figure 2:
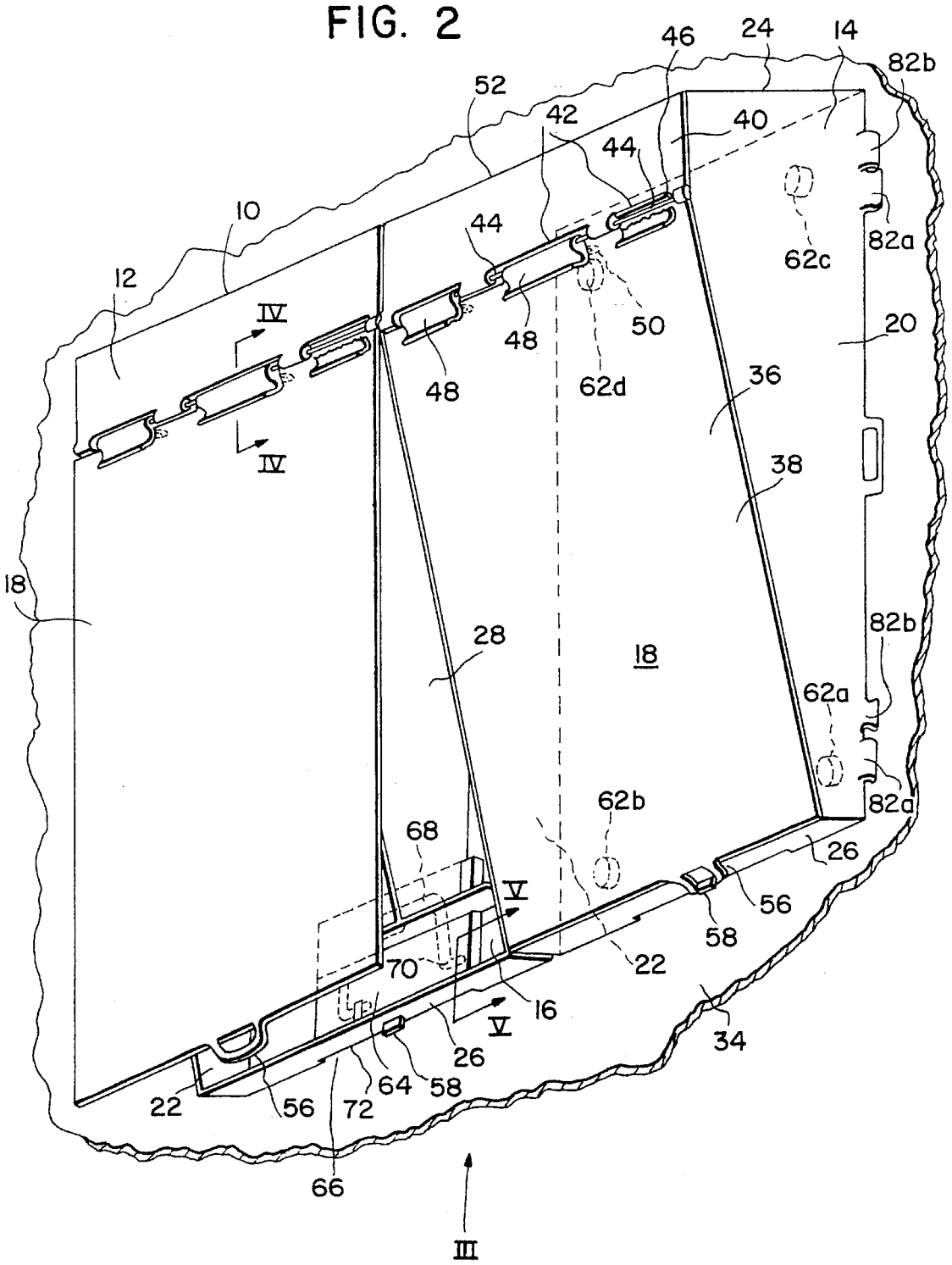
FIG. 2 is an isometric view of the bingo box of FIG. 1 in a working configuration supported on a table support surface.

When the bingo box 10 is in a working mode, or configuration, as is shown in FIG. 2, the base sidewalls 16 of the first and second containers 12 and 14 are coplanar to one another and are immediately adjacent to, and parallel to, a horizontal support surface 34 (such as a table top) on which the bingo box 10 is resting. In this attitude the tapered right and left edge walls 20 and 22, and the wider and narrower end walls 24 and 26, are substantially perpendicular to the horizontal support surface 34 and the work sidewall 18 is held above the horizontal support surface 34 by upper edges of the edge and end walls 20, 22, 24, and 26 and the interior dividers 32 for receiving bingo cards on an angled surface 36 of a hinged angled panel 38 forming a part of the work sidewall 18. In this regard, the work sidewall 18 is formed of a stationary panel 40 which is rigidly attached to the tapered right and left edge walls 20, 22 and the wider end wall 24. However, the hinged angle panel 38 is attached to the stationary panel 40 by means of hinge elements 42.

Figure 4:
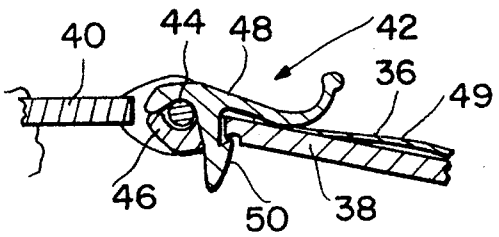
FIG. 4 is a segmented cross-sectional view taken on line IV—IV in FIG. 2.

In the depicted embodiment the hinge elements 42 include hinge pins 44 which are formed as one piece with the stationary panel 40, and curved tabs 46 which are formed as one piece with the hinged angled panel 38 and which loop about bottom sides of the hinge pins 44. Clamps 48 also form part of the hinge elements 42 in that they include clip elements 50 which engage in openings in the hinged angled panel 38 and loop over the hinge pins 44 to thereby rotatably enclose the hinge pins 44 between the clamps 48 and the tabs 46. This structure is shown in detail in FIG. 4.

The clamps 48 serve the dual purpose of also clamping paper, or bingo cards 49, to the angled surface 36 of the hinged angled panel 38 as will be described in more detail below.

The stationary panel 40 is molded as one piece with other walls of the container (with the exception of the hinged angled panel 38 which is molded as a separate part) and the interior dividers 32; however, during molding the stationary panel 40 is not positioned against the tapered right and left edge walls 20 and 22, as shown in FIG. 1, but rather is attached to the wider end wall 24 by a living hinge 52 and is rotated away from the tapered right and left edge walls 20 and 22. After molding, the stationary panel 40 is rotated about the living hinge 52 so that the stationary panel 40 presses against edges of the tapered right and left edge walls 20 and 22 and it is held thereto by means of screws 54 which extend from wells 55 in the base sidewall 16, as can be seen in FIGS. 1 and 3.

The hinged angled panel 38 has at a foot end thereof, opposite its hinged end, a loop latch 56 which is molded as one piece with the hinged angled panel 38. The loop latch 56 is for looping about a protrusion catch 58 on an outer surface of the narrow end wall 26. When the hinged angled panel 38 is in a closed position, as are the hinged angled panels 38 shown in FIG. 3, the loop latch 56 can be looped about the protrusion catch 58 to retain the hinged angled panel 38 in the closed position.

Figure 3:
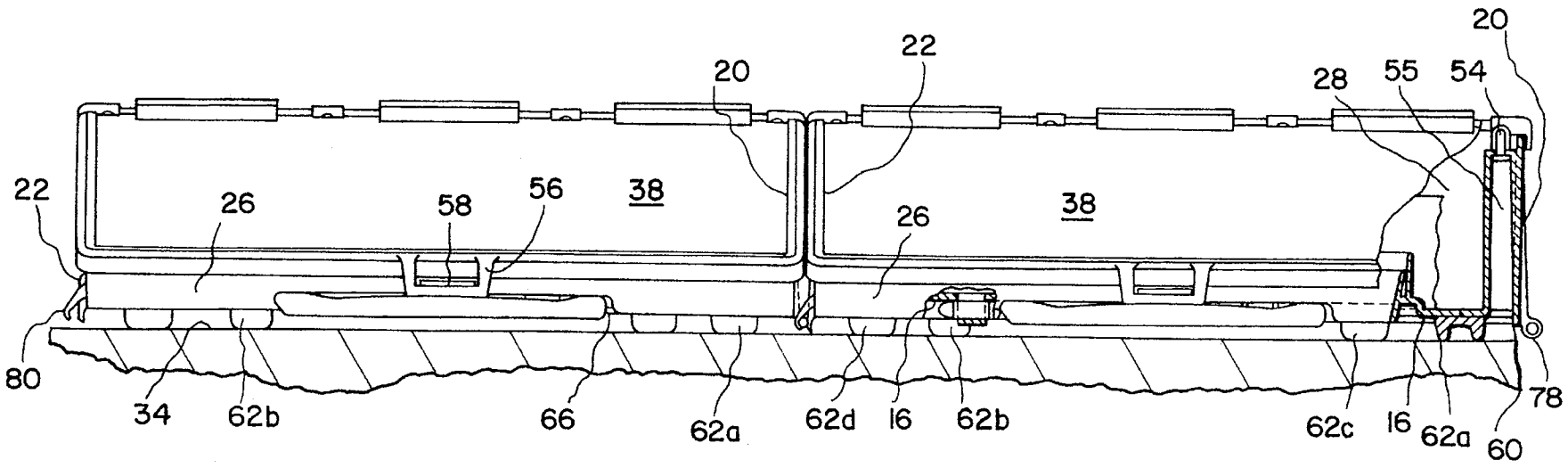
FIG. 3 is an elevational, partially-cutaway, view taken from the direction III in FIG. 2, but with a few changes being made for purposes of explanation.

As can be seen in FIG. 3, the base sidewall 16 has footpads 62*a–d* mounted thereon. As can be seen in FIGS. 2 and 3 a front pair of footpads 62*a, b* located close to the narrow end wall 26 are offset toward the tapered right edge wall 20, whereas a rear pair of footpads 62*c* and *d*, which are closest to the wider end wall 24, are offset toward the tapered left end wall 22. In this manner when the first and second containers are rotated to be in the carrying configuration as shown in FIG. 1, with their base sidewalls 16 immediately adjacent and parallel to one another, the footpads 62*a–d* do not touch one another but rather avoid one another and make contact with the opposite base sidewall 16.

Figure 5:
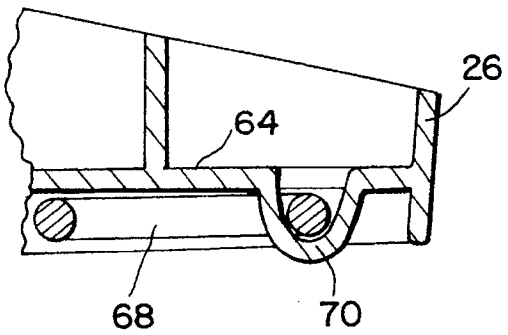
FIG. 5 is a segmented cross-sectional view taken on line V—V in FIG. 2.

The base sidewall 16 includes a recessed portion 64 for forming a cavity 66 to hold a rotatable handle 68. The rotatable handle 68 is attached to the recessed portion 64 of the base wall 16 by molded brackets 70, molded as one piece with the base sidewall 16 (see FIG. 5), which allow the handle 68 to be snapped thereinto to be rotatable between a deployed position as shown in FIG. 1 and a stored position as shown in FIG. 2. The narrow end wall 26 has a notch 72 therein corresponding to the cavity 66 for allowing the rotatable handle 68 to extend outwardly beyond an outer surface of the narrow end wall 26.

The wider end wall 24 also has footpads 74*a* and *b* on an outer surface thereof to support the bingo box 10 from a floor support surface 76 when the bingo box is in a carrying configuration, as shown in FIG. 1.

The edges 60 of the tapered right and left edge walls 20 and 22, adjacent the base sidewall 16, respectively have right and left hinge elements 78 and 80 mounted thereon. In this regard, in the embodiment shown in FIGS. 1 and 2 the right hinge elements 78 comprise flexible opposing tongues 82*a* and *b* which are molded as part of the right edge wall 20 at the edge 60 thereof. The left hinge elements 80 are pins 84 which are molded at the edge 60*a* of the left edge wall 22. As can be seen in FIG. 1, the hinge tongues 82*a* and *b* and the hinge pins 84 removably, and flexibly, engage one another to allow the first and second containers 12 and 14 to rotate relative to one another about the edges 60 and 60*a* of the right and left edge walls 20 and 22.

In this regard, it should be noted that the first and second containers 12 and 14 are identical in structure so that the tapered right edge wall 20 of each of the first and second containers 12 and 14 has right hinge elements (hinge tongues) thereon and the tapered left edge wall 22 of each of the first and second containers has the left hinge elements 80 (pins) thereon. Thus, when the first and second containers are placed with their base sidewalls 16 against one another as shown in FIG. 1, the hinge pins and the hinge tongues come into engagement with one another at both ends of the containers. The hinge elements at one end of the containers can serve as hinges whereas the hinge elements at the other end of the containers can serve as catches to hold the first and second containers 12 and 14 together in the carrying configuration shown in FIG. 1. To further ensure that the first and second containers 12 and 14 stay together in the carrying configuration the right edge wall 20 has a latch 86 molded thereon and the left edge wall 22 has a catch pin 88 molded thereon to interengage one another. Again, complementary latch and catch elements are located identically on the first and second containers so that when the base sidewalls 16 of the first and second containers are placed together complementary elements come together as shown in FIG. 1.

In one embodiment, almost all elements of the bingo box 1, are molded of a resinous plastic. Each of the first and second containers 12 and 14 includes one main piece formed of all rigid walls and interior dividers. Other separate pieces include the hinged angled panel 38, the clamps 48, the rotatable handle 68, and possibly bumpers for the footpads 62*a–d* and 74*a* and *b*. Separate brackets 70 can be used for holding the handle 68 to the base sidewall 16, but in a preferred embodiment, these are also molded as one piece with the base sidewall 16 and ends of the handle 68 (which are directed in the same direction) are snapped thereinto. A few separate screws, such as screws 54 are also required. The footpads can include separate non-slip material.

Tapered top edges of the tapered right and left edge walls 20 and 22, which are adjacent the hinged angled panel 38, form an angle of approximately 10° or 11° with the horizontal support surface 34, thereby placing the hinged angled panel 38, when the bingo box 10 is in the working configuration of FIG. 2, at an angle of approximately 10° with the horizontal when it is closed. The hinged angled panel 38 is formed of a planar sheet which is approximately 13 in.×13 in. so that when the bingo box is in the working configuration, as shown in FIG. 2, an angled planar surface of 13 in.×26 in. is provided. Each of these surfaces 36 is large enough to hold three bingo sheets, each containing three bingo cards. Thus, one can place eighteen cards on an angled planar surface provided by the bingo box 10 when it is in the working configuration of FIG. 2.

Similarly, the stationary panel 10 provides a 2 in.×13 in. shelf which becomes a 2 in.×26 in. combined shelf for the entire bingo box 10 when it is placed in the working configuration shown in FIG. 2. This shelf can be used to hold dobbers, glue, pencils, ashtrays and so forth when the bingo box is in the working configuration shown in FIG. 2. However, when the bingo box is in the carrying configuration shown in FIG. 1, the stationary panel 40 becomes a barrier to prevent contents from falling out of the storage space 28 when the hinged angled panels 38 are opened for retrieving items from the storage spaces or placing items into the storage space.

In use, the right and left hinge elements 78 and 80 at respective right and left ends of the first and second containers 12 and 14 of the bingo box 10 are interengaged as are the associated latch. 86 and catch pin 88. These right and left hinge elements 78 and 80 allow relative rotation between the first and second containers 12 and 14 and the engaged latch 86 and catch 88 ensure that this hinged relationship is maintained. The right and left containers 12 and 14 can thus be rotated so that their base sidewalls 16 are substantially coplanar, as shown in FIG. 2, and their footpads 62*a–d* can be placed on the table support surface 34. Now the bingo box can be used as a desk for playing bingo on the angled surfaces 36 formed by the hinged angled panels 38. The clamps 48 can be used for holding bingo cards and/or other papers on the angled surfaces 36. When the bingo box is in the working configuration as shown in FIG. 2, access can easily be had to the storage spaces 28 by detaching the loop latches 56 from their respective protrusion catches 58 and rotating the hinged angled panels 38 upwardly, as is show for the hinged angle panel 38 on the left side in FIG. 2. Deployed in this manner, the footpads, 62*a–d* protect the right and left hinge elements 78 and 80 from the support surface 34, to thereby protect these elements.

When one wishes to fold the bingo box 10 into the carrying configuration shown in FIG. 1 the first and second containers 12 and 14 are rotated about their right and left hinge element 78, 80 until the base sidewalls 16 of the first and second containers approach one another. When this happens, the right and left hinge elements 78 and 80, which are opposite the left and right hinge elements 80 and 78 about which the containers are rotating, also come into engagement with one another to hold the bingo box in the carrying configuration shown in FIG. 1. Once the bingo box is in this position the latch 86 and catch pin 88 at the other end of the bingo box are also engaged to help retain the bingo box in the carrying configuration. In the carrying configuration the storage spaces 28 can also be easily accessed via the hinged angled panels 38 without fear of materials falling out of the storage space.

It is beneficial that each of the first and second containers 12 and 14 are identically made because in this manner the bingo box can be manufactured relatively inexpensively, since a single mold can be redundantly used for both containers.

Yet another benefit of constructing the right and left hinge elements to complement one another is that the first and second containers shown in the drawings above can be interengaged with yet a third container for forming still a wider working surface in the working configuration.

Similarly, it is beneficial that when the bingo box is in the carrying configuration it is symmetrical relative to the rotatable handles 68, being wide at the bottom and narrow at the top, so that it hangs straight when held by the handles 68. Because of this the bingo box is relatively easy to carry and can rest stably on a floor support surface.

Yet another benefit of the bingo box of this invention is that the hinged angled panels 38 can be opened when the bingo box is either in the working configuration or in the carrying configuration without fear of materials falling from the storage space of the bingo box. In this regard, the stationary panels 40 serve as a barrier to prevent things from falling from the storage space when the bingo box is in a carrying configuration. The stationary panel also provides the benefit of a shelf for holding things when the bingo box is in the working configuration.

It is also beneficial to provide footpads 62*a–d* on the base sidewall because in this manner the hinge elements formed on the adjacent edges are protected from contact with support surfaces. Also, it is beneficial that the footpads are of non-slip material so as to prevent the bingo box from sliding about when it is in the working configuration.

It is beneficial to form a cavity on a lower side of the base sidewall for holding the handle because in this manner the handle does not get in the way of materials placed in the storage space.

While the invention has been particularly shown and described with reference to a preferred embodiment, it will be understood by those of ordinary skill in the art that various changes in form and detail may be made therein without departing from the spirit and scope of the invention. For example, the right and left hinge elements 78 and 80 have been reversed in the embodiment of FIG. 3 from the embodiment of FIGS. 1 and 2 in order to show that this is possible.

Although the bingo box of this invention has been described in the context of its use for playing bingo, it is basically a portable desk which could be used for performing other paper work as well and for storing and carrying other types of materials.

Figure 6:
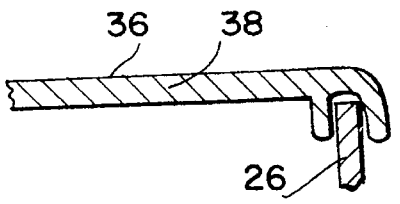
FIG. 6 is a segmented cross-sectional view of an edge portion of a hinged angled panel of this invention of an enhanced embodiment.

In one embodiment shown in FIG. 6 the hinged angle panel 38 has two shallow ribs substantially at a right angle to the surface 36, about three edges thereof, to form a peripheral groove for receiving top edges of the right and left edge walls 20 and 22 and the top edge of the narrow end wall 26. This provides strength to the hinged angled panel 38 and also adds strength to the entire bingo box 10 when it is closed because of the interengagement thereby provided.

The embodiments of the invention in which an exclusive property or privilege are claimed are defined as follows:

1. A bingo box comprising:

relatively rigid first and second containers, each having base and work sidewalls opposite each other, tapered right and left edge walls opposite each other, and wider and narrower end walls opposite each other, said walls being interconnected to define together a storage space therebetween such that when the base sidewall is supported at, and approximately parallel to, a horizontal support surface the end walls are substantially perpendicular to the horizontal support surface and the work sidewall is held above the horizontal support surface at upper edges of the end walls for receiving bingo cards on an angled outer surface of the work sidewall, there being a handle at said narrower end wall of at least one of said first and second containers for being used to carry said bingo box;

wherein each of said work sidewalls includes at least one angled panel attached to other elements of the respective first and second container by a hinge, said angled panel defining said angled outer surface when said angled panel is in a closed position for closing said storage space, but said angled panel being rotatable on said hinge to an open position for providing access to said storage space;

wherein said first container includes a right complementary hinge means at an intersection of its tapered right edge wall and base sidewall and the second container includes a left complementary hinge means at an intersection of its tapered left edge wall and base sidewall, said right and left complementary hinge means having the function of engaging one another for allowing said first and second containers to rotate relative to one another between a carrying configuration in which said base sidewalls are adjacent one another and a working configuration in which said base and work sidewalls are approximately coplanar to one another;

wherein, when said first and second containers are in said carrying configuration said handle can be used for carrying both said first and second containers, and anything in said storage compartments, while said angled panels can be hinged for access to said storage space; and wherein, when said first and second containers are in said working configuration they can be simultaneously placed on said horizontal support surface, with said base sidewalls adjacent said horizontal support surface, and bingo cards can be place on said angled panel for playing said bingo cards while said angled panels can be hinged for accessing said storage space.

2. A bingo box as in claim 1 wherein said first and second hinge means are for being selectively engaged with and disengaged from one another.

3. A bingo box as in claim 2 wherein said first and second containers are substantially identical in structure, with said first container also having a left complementary hinge means at an intersection of its tapered left edge wall and base sidewall and the second container having a left complementary hinge means at an intersection of its tapered left edge wall and base sidewall.

4. A bingo box as in claim 1 wherein is further included interior dividers for dividing said storage space into separate compartments.

5. A bingo box as in claim 1 wherein each of said first and second containers includes a handle and a handle attaching means for attaching said handle to its respective container for allowing said handle to be moved between an active position in which it is deployed beyond an outer surface of said narrower end wall and a stored position in which it is entirely within the outer surface of said narrower end wall.

6. A bingo box as in claim 5 wherein said handle mounting means allows said handle to rotate.

7. A bingo box as in claim 1 wherein said base walls of said first and second containers have footpads thereon for extending beyond the respective complementary right and left hinge means to prevent the right and left hinge means from engaging the horizontal support surface when the first and second containers are in the working configuration.

8. A bingo box as in claim 7 wherein additional footpads are mounted on an outer surface of the wider end wall.

9. A bingo box as in claim 1 wherein footpads are mounted on an outer surface of the wider end wall.

10. A bingo box as in claim 1 wherein a portion of said work surface at an intersection of the wider end wall and the work surface is a stationary panel to form a storage shelf when said bingo box is in the working configuration and to form a barrier for retaining materials in said storage space when said bingo box is in the carrying configuration.

11. A bingo box as in claim 10 wherein the stationary panel is approximately parallel to the base sidewall.

12. A bingo box as in claim 1 wherein the first and second containers are substantially identical.

* * * * *